United States Patent [19]

Martin

[11] 4,044,880

[45] Aug. 30, 1977

[54] HIGH SPEED WHEEL PRINTER AND METHOD OF OPERATION

[75] Inventor: Blair Robertson Martin, Owego, N.Y.

[73] Assignee: International Business Machines Corporation, Armonk, N.Y.

[21] Appl. No.: 617,913

[22] Filed: Sept. 29, 1975

Related U.S. Application Data

[63] Continuation-in-part of Ser. No. 427,962, Dec. 26, 1973, abandoned.

[51] Int. Cl.[2] ..... B41J 1/26; B41J 19/30

[52] U.S. Cl. ..... 197/18; 197/53; 197/82

[58] Field of Search ..... 101/93.13, 93.14, 93.18, 101/93.19; 197/16, 18, 49, 82, 53–55; 318/685, 696

[56] References Cited

U.S. PATENT DOCUMENTS

| | | | |
|---|---|---|---|
| 3,168,182 | 2/1965 | Bernard et al. | 197/55 |
| 3,342,296 | 9/1967 | Greene | 197/17 X |
| 3,356,199 | 12/1967 | Robinson | 197/53 X |
| 3,516,528 | 6/1970 | Davidge et al. | 197/16 |
| 3,724,631 | 4/1973 | Kaczeus | 197/49 |
| 3,742,845 | 7/1973 | Giani | 101/93.19 |
| 3,908,809 | 9/1975 | Beattie | 197/54 X |
| 3,924,725 | 12/1975 | Kuhn et al. | 197/53 |

*Primary Examiner*—Edgar R. Burr
*Assistant Examiner*—Paul T. Sewell
*Attorney, Agent, or Firm*—John S. Gasper

[57] ABSTRACT

A print wheel is rotatably mounted on a carrier driven by a stepper motor to traverse the print line of a document. The wheel contains two or more arrays of characters with preferred characters most commonly used in each array and a number of lesser-used characters divided between the arrays. The print wheel normally makes one revolution for each two or more print positions and if a compare is made in each array the stepper motor advances the carrier at constant speed. Should a compare not be found or the character desired be too close to a previous character for the print hammer to settle out, the stepper motor is stopped for that position until a compare is made in some following array.

18 Claims, 5 Drawing Figures

(GAP IN PRINTWHEEL CORRESPONDS TO MISSING EMITTER TOOTH)

ARRAY 1: $'JVHMBLISRT-96E52.014387ACDONF*P,Y=)+□
ARRAY 2: Z(KXUMBLISRT-96E52.014387ACDONF*P,G/WQ&

HIGH SPEED WHEEL PRINTER AND METHOD OF OPERATION

This application is a continuation in-part of co-pending application, Ser. No. 427,962, filed Dec. 26, 1973 by Blair R. Martin, entitled "High Speed Wheel Printer", now abandoned.

BACKGROUND OF THE INVENTION

1. Field of the Inventiion

The invention relates generally to printers and it has reference in particular to serial printers and a method of operation thereof wherein a single print element such as a rotating print wheel and an associated print hammer are moved along the print line of a document to print thereon.

2. DESCRIPTION OF THE PRIOR ART

Serial line printers are known in which the print mechanism comprises a single print element having plural type characters arranged in one or more sets in a predetermined sequence thereon. The print mechanism is operated to move or orient the print element to present the desired characters to be printed at a print position where contact is made with a record medium. A line of characters or other symbols is formed by effecting a lateral motion of the print mechanism and the record medium along a print line comprised of a plurality of uniformly-spaced print positions on a record medium. The operation of the print mechanism and its lateral movement must be coordinated so that the desired type is in position to make contact with the record medium when the print mechanism has moved to the desired print location. The rate at which single print element printers can print characters basically depends on the operation or set-up time required by the print mechanism; that is, the time for the print element to be moved to bring the next desired character into position to be actuated to make contact with the paper and recover for the next print operation.

Various ways have been devised to increase the throughput rate of Ser. printers. For example, in U.S. Pat. No. 3,461,225, issued on Aug. 12, 1967 to F. P. Willcox et al., entitled "Data Transmission System and Printer", a single print element comprises a disk or wheel with plural characters formed on flexible fingers around the periphery of the wheel. The typewheel and its hammer mechanism are mounted on a carrier which is moved laterally in a step-like motion along the print line. The typewheel is rotated at a constant speed at a rate such that a complete set of characters is presented for printing at each print position. In U.S. Pat. No. 3,371,766, issued Mar. 5, 1968 to Karel J. Staller, entitled "Printing Apparatus" and U.S. Pat. No. 3,356,199, issued Dec. 5, 1967 to Leland P. Robinson, entitled "Printer Having Type Disk Rotatable In A Plane Parallel To The Printing Line", the typewheel is rotated continuously while being transported continuously by the carrier along the print line. While the continuously moving carrier provides an increased throughput printing rate over the incremental carrier movement, the velocity of the carrier must coincide with the maximum time required for the typewheel to positin a complete set of type characters at each print position.

SUMMARY OF THE INVENTION

Generally stated, it is an object of this invention to provide for increasing the throughput of a serial type printer.

It is a more specific object of this invention to provide an improved serial printer of the type having a single print element and an improved method of operation therefor.

It is a further object of this invention to provide an improved serial printer and method of operation therefor in which the print element is a disk or wheel or the like.

Basically, this invention is founded upon the fact that the time for presenting characters herein referred to as set-up time of a single print element such as a hwheel, ball or the so-called stick, whether continuously rotated or moved with another type motion, varies in dependence on the distance the print element must move from the one character recorded at one print line position to the next character desired to be printed at the adjacent print line position. The invention further is based upon the fact that in any given line of a pluraliity of characters to be printed a large percentage of the successive characters to be printed can be set up within a relatively short time compared to the maximum time required to set up the more remote characters in one or more complete sets of characters.

This invention therefore, breifly stated, involves normally effecting the relative lateral motion of the print mechanism and the record medium of a serial printer at a predetermined velocity such that the traverse time between adjacent print locations of a print line is shorter than the maximum set up, time for the print mechanism. The lateral motion is maintained constant at the predetermined velocity so that printing occurs on-the-fly so long as the set-up time for the printing mechanism for printing successive desired characters occurs within the traverse time between adjacent print locations. In the event the set-up time of the print mechanism exceeds the traverse time, the velocity during motion between adjacent print positions is temporarily altered and then restored to the predetermined level for printing. In the preferred method of practicing this invention the print mechanism uses a type disk or wheel which is constantly rotating, the print mechanism is mounted on a carrier moved laterally along a print line, the record medium is held stationary, and the velocity of the carrier is reduced to zero, i.e. stopped, for various intervals when the set-up time of the print mechanism to set up to print the next character exceeds the normal traverse time between adjacent print positions. The carrier is later accelerated from zero to the initial velocity at such a time that, by the time it reaches the next print position, the set-up function of the print mechanism has been completed. In this manner, the throughput printing rate can be increased over printers in which the motion of the carrier is always fixed at the maximum time for the print mechanism to be set up for every print location of the print line. Additionally, printing occurs always on-the-fly with the type characters making contact with the record medium while moving at the same velocity, thereby maintaining a relatively constant quality of printing impression.

In the preferred manner of practicing this invention, the type element is a print wheel having two or more arrays of characters arranged in successive segments around the periphery of the wheel where each array has the more commonly used characters, while the lesser used characters are distributed among the arrays. In this manner the print mechanism can be moved plural print positions for each revolution of the print wheel and stopping the carrier occurs only when the character for a particular position cannot be found in an array, thereby further increasing the throughput capability of the printer.

Also, in accordance with this invention, printing occurs on-the-fly with the print wheel and carrier both moving except when successive adjacent print positions call for characters which are too close together on the print wheel to permit settling of the print hammer from a previous operation, whereupon the carrier alone is stopped and started again.

It is a further feature of this invention to provide a control means which uses a lookup table on the like to determine the next character to be printed and also the next-but-one so that a decision can be made whether the print wheel carrier shall continue to move or will have to be stopped in order to print the desired character in each print position along a print line.

DESCRIPTION OF THE PRFERRED EMBODIMENT

Figure 1:
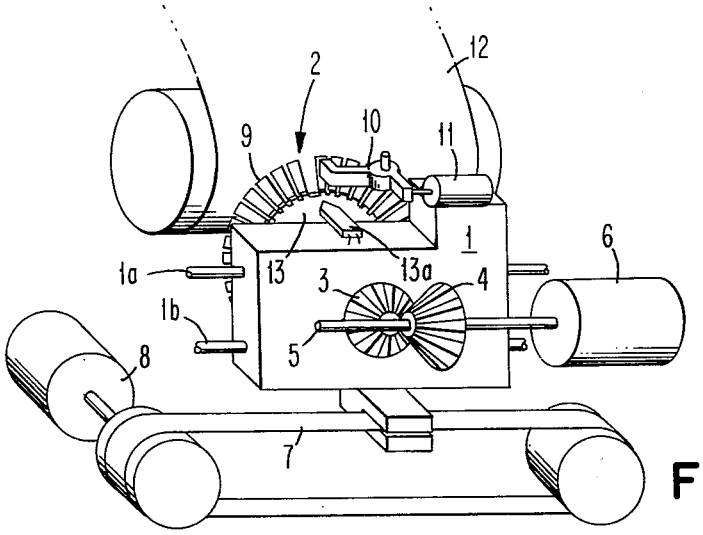
FIG. 1 is a schematic showing of a portion of a printer appparatus adapted for using the invention.

Referring to FIg. 1, a laterally sliding carrier 1 mounted on guides 1a and 1b carries a print mechanism comprising continuously rotating print wheel 2 driven by a bevel gear 3 which mates with a sliding bevel gear 4 on a spined drive shaft 5 driven by a constant speed electric motor 6. The carrier 1 is driven by a toothed belt 7 driven by a stepping motor 8. During the printing of any character the carrier 1 is always in motion from left to right, but it can be stopped and restarted by appropriate control of the stepping motor 8. Alternatively, the paper 12 and platen can be moved and the print mechanism and carrier 1 retained in fixed position.

Figure 2:
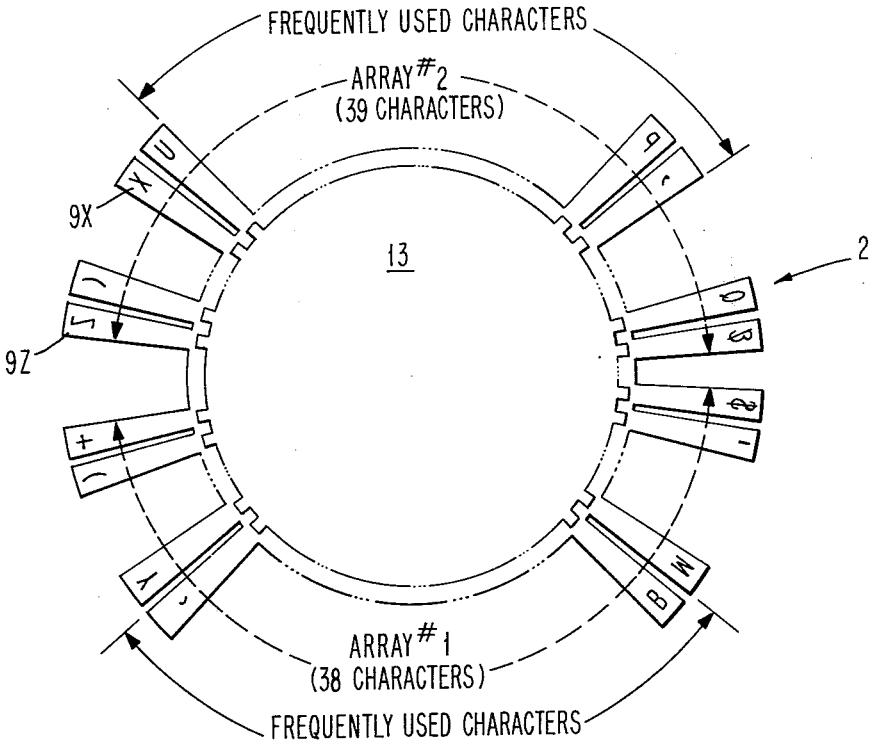
FIG. 2 is a schematic representation of a spoked print wheel utilizing a preferred character arrangment of the type characters in accordance with the teachings of the invention.

In the preferred embodiment the print wheel 2 comprises a disk having a number of movable type elements such as the flexible spokes or type fingers 9A–Z, etc. Printing of any desired character by the print mechanism, 9X for example, as shown in FIG. 2, is brought about by operating a print hammer 10 which may be actuted by a solenoid 11, both of which are mounted on the carrier 1. When the appropriate type finger such as 9X approaches the printing position, the solenoid 11 actuates the hammer 10 into contact with the type finger driving it into contact with the paper 12. An emitter wheel 13 rotating with the print wheel 2 cooperates with a magnetic sensor 13*a* to produce a stream of emitter index pulses for controlling the operation of the printer, one for each character with a home pulse for each revolution of the print wheel, produced for example by having a missing tooth on the emitter 13. The printer controls can thus determine the angular position of the print wheel 2 at any time.

Although the carrier 1 is moving at the time of printing any character, the firing of the hammer 10 is timed so that the center line of the selected character is correctly aligned with the center line of the print column in which it has been printed.

In the preferred embodiment the invention calls for the number of type fingers on the print wheel 2 to be greater than the number of different characters to be printed. Preferably, the type fingers are divided into two or more arrays of about equal size, as shown in FIG. 2. The most frequently used characters are duplicated in the arrays while the lesser used are placed in one array only. Within each array the most frequently used characters are arranged in the middle with the lesser used characters at the ends.

During printing the motion of the carrier 1 is synchronized with the continuously rotating print wheel 2 so that the carrier 1 traverses exactly one column width as each array of type fingers passes the printing position. That is to say, two or more characters (as many characters as there are arrays on the print wheel) can be printed during each print wheel revolution.

However, this printing rate cannot be maintained continuously. There are two different circumstances in which the printing must be interrupted. (1) The next character to be printed is found to be absent from the next array to pass the printing position. (2) Two successive characters to be printed are so close to each other on the print wheel that the hammer 10 does not have time to recover after printing the first one before the second character comes around. In either case the carrier 1 must be momentarily halted and then restarted when another array containing the required character approaches the printing position, since the traverse time of the carrier 1 between print positions is less than the set-up time for the print mechanism. In that case, one or more print cycles are lost every time this happens; the actual number in any instance depends upon the print wheel layout and on the mechanical characteristics of the carrier drive mechanism. This causes some degradation in the average printing speed. However, analysis of practical configurations shows that the actual printing speed will lie between 90% and 99% of the theoretical maximum; that is: at least 80% faster than it is possible without this invention.

Figure 3:
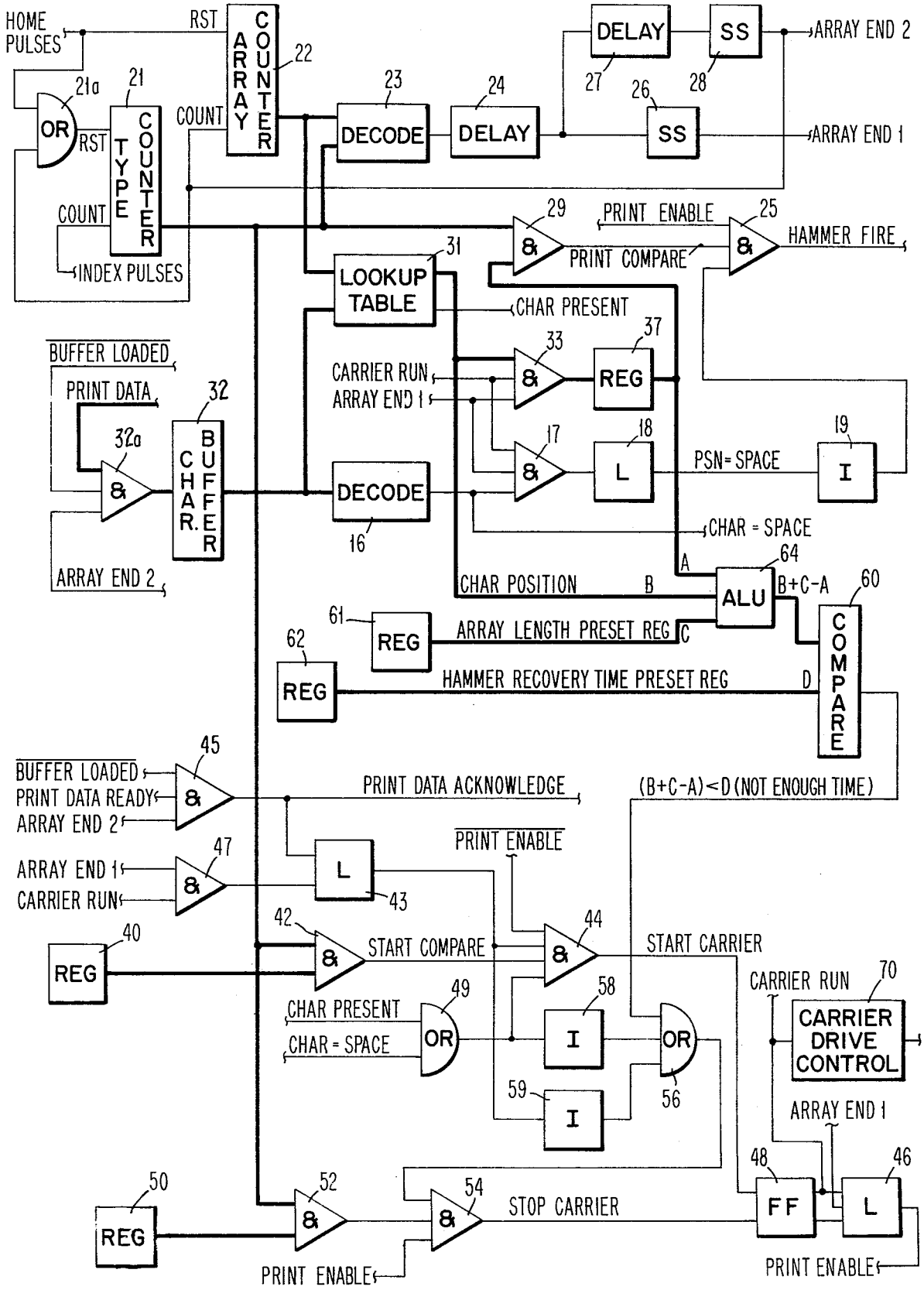
FIG. 3 is a schematic block diagram of a portion of the printer control system for controlling the operation of the type carrier in accordance with the invention.

Referring to FIG. 3, logic circuitry is shown wherein a type counter 21 responsive to index pulses and reset by home pulses or array end 2 pulses through OR 21*a*, is connected to the emitter transducer 13a of FIG. 1 for providing a numerical indication of the print wheel type character in the printing position. The output of the type counter 21 is applied to a compare circuit 29 and to an AND circuit 25 for providing a hammer fire pulse for operating the print hammer solenoid 11 through a hammer driver 71. A decode circuit 16 is provided to identify a space designation in the character buffer 33. AND 17 and a position space latch 18 together with inverter 19 inhibit operation of the print hammer fire signal for a space.

The type counter 21 output also drives an array counter 22 for providing through decode AND circuits 23, delay 24, and single shot 26, and delay 27 and single shot 28, array end 1 and array end 2 signals for each of the arrays of characters on the print wheel 2. These signals occur about 50 microseconds apart at the end of each array in the order designated, first 1 then 2. A lookup table 31 receives as inputs the output of a character buffer 32 (which is the code representation of the character to be printed) and the output of the array counter 22 (which is the binary value of the next array that will pass in front of the print hammer). The lookup table 31 produces as outputs a character present signal indicating whether the character in the character buffer 32 is present in the next array, and a binary character position signal indicating the position of the character in that array. One output from the lookup table 31, namely, the next character position, is applied to an AND 33 for operating a register 37 which contains the next character position to be printed. The output of this register is applied to the compare circuit 29 to match with the print wheel position input for controlling hammer fire at AND 25.

An additional preset input quantity is provided by register 40 which is connected to a compare AND 42 together with an output from type counter 21 for determining the time at which the print wheel may be started to maintain synchronous operation. The start compare output from AND 42 is applied to an AND 44 together with an output from a buffer loaded latch 43 which is set thru AND 45 by a printer data ready from the system, a buffer not loaded signal, and an array end 2 signal from single shot 28, and is reset through AND 47 by array end 1 signal and carrier run from flip-flop 48. A print enable signal from triggered latch 46 is also applied to the AND 44 along with a character present or a space signal from OR 47.

The signal from AND 44 is applied to a carrier run flip-flop 48 for turning on the carrier drive control 70 to drive the carrier motor 8, as well as gate the hammer fire signal at AND 25 by means of the print enable signal from triggered latch 46.

An additional present quantity is provided by register 50 and connected to a compare circuit 52 along with the output of the type counter 21 for providing a stop compare signal for stopping the carrier motor 8. The stop compare signal is applied to AND 54 along with the print enable signal from the triggered latch 46 and the output of an OR 56 for resetting the carrier run flip-flop 48. An inverter 58 is used to connect the character present or space signal input from OR 49 input to the OR 56 for resetting the carrier run flip-flop 48 whenever a character or a space is not present. Inverter 59 connects the buffer loaded latch to OR 56 for resetting the carrier run flip-flop 48 whenever the latch is reset.

A compare circuit 60 is provided having as one input a quantity from a preset hammer recovery time register 62, and as the other input the difference between the sum of the output of a preset array length register 61 and the character position from lookup table 31, and the output of the next character position register 37 as determined by arithmetic logic 64. In the event that the output of 64 is less than the preset hammer recovery time from the register 62, the output of the AND 60 resets the flip-flop 48 through OR 56 and AND 54 to stop the carrier drive motor 8 through carrier drive control 70. Registers 40, 50, 61 and 62 contain, for example, seven bit binary coded numbers such as, 0010010, 0011110, 0100111 and 0001001 which are the decimal values 18, 30, 39 and 9, respectively.

Starting with a print wheel 2 rotating and the carrier 1 at rest, the logic shown in FIG. 3 initiates carrier motion at such time that the carrier 1 will just be up-to-speed when the array containing the first character to be printed approaches the printing position. Hereafter, printing continues at maximum possible speed. Before printing each character the logic determines whether it will be possible to print the following character out of the next-but-one array. If not, a carrier stop is initiated at the proper time during or just after traversing the last printable column. (Depending on the mechanical characteristics of the system, the stop may have to be initiated before the hammer is fired to print the last chracter.) When the carrier 1 has come to rest the start up section of the logic takes over again and reinitiates carrier motion as described above.

Figures 4, 5:
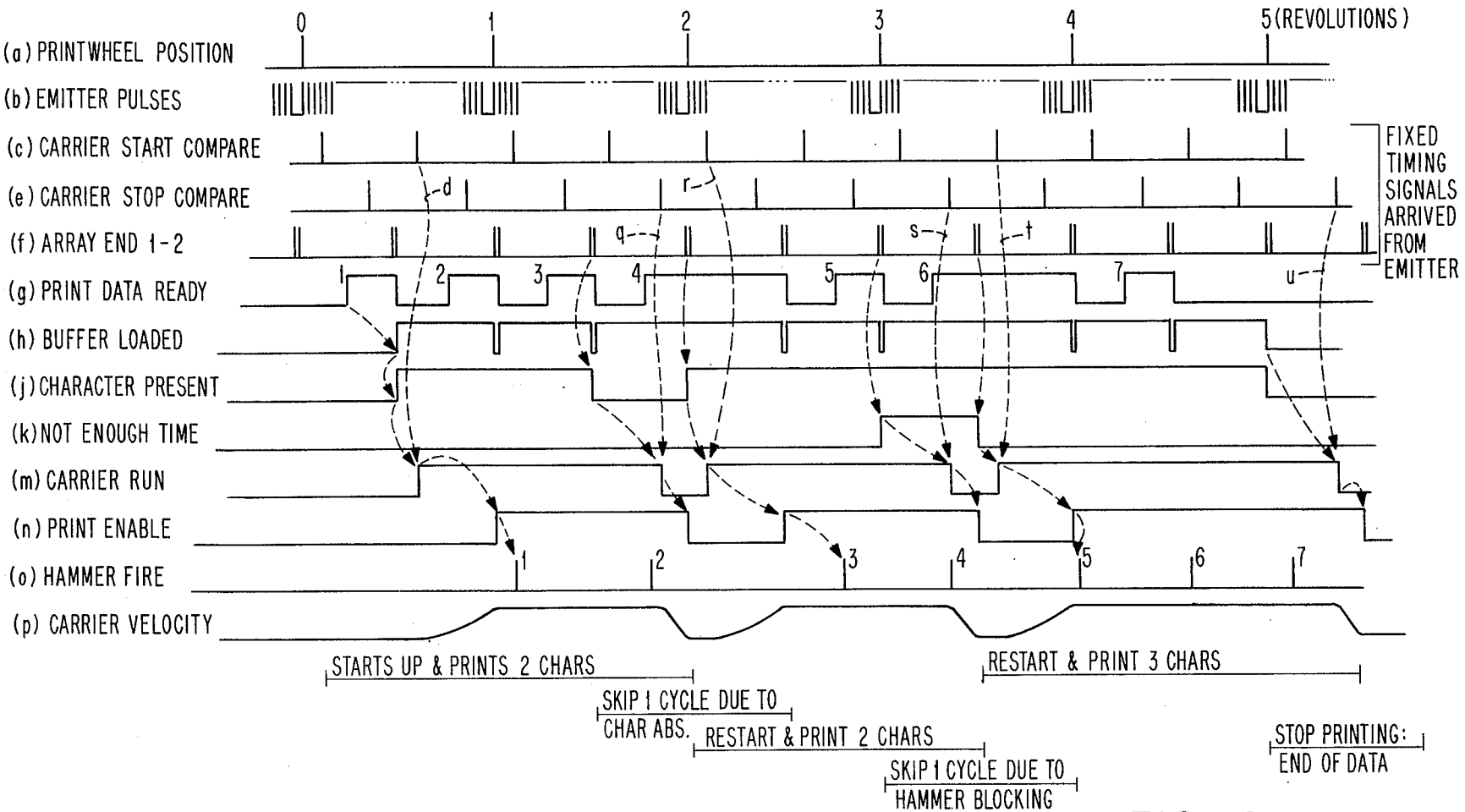
FIG. 4 shows a set of timing curves illustrating the operation of the controls in FIg. 3.
FIG. 5 is a table showing a preferred arrangement of the type characters to be used on the print wheel.

Referring to FIG. 4, the group of curves b show the relationship of the emitter index pulses from the emitter 13 relative to the position of the print wheel 2 in the different print positions shown in *a*. Upon the occurrence of a carrier start compare signal from the AND 42 of FIG. 3 shown in curve *c*, the dotted line *d* shows the sequence for starting and printing two characters. As shown, the carrier run flip-flop 48 is turned on by AND 44 upon the concurrence of the carrier start compare signal from AND 42, a buffer loaded signal from latch 43 in curve *h*, and not print enable signal from the carrier drive latch 46. A print data ready signal g from the system is used to turn on the buffer loaded latch 43 producing output *h*. The carrier run flip-flop 48 is turned on, producing carrier run signal *m* and activating the carrier drive control 70 to start the carrier drive motor 8. When the character to be printed is in position, the print enable signal *n* from the print enable latch 46 gates with a print compare signal in AND 25 and causes the print hammer to fire as shown in curve *o*. At this time the carrier 1 is up to velocity, as shown by the carrier velocity curve *n*.

When the lookup table 31 determines what the next character position is, a character present output will also be produced if this character is in the next array, as shown in the curve *j*. The lookup table 31 determines in this instance that the third character transmitted from the system is not present in the next array so that the OR 56 is activated through inverter 58 and in conjunction with a stop compare signal from AND 52, the AND 54 produces an output to reset the carrier run flip-flop 48 and stop the carrier drive motor 8. This is shown by the dotted line *q* where the character present signal curve *j* is turned off, producing a carrier stop compare signal curve *e* which turns off the carrier run signal from flip-flop 48 upon the occurrence of the stop compare signal *e*, as shown at *m*, so that we skip one cycle because of the next character being absent.

The next array does contain the character, so the character present signal is turned on by the lookup table 31 when the array counter 22 is indexed.

Upon the occurrence of the next carrier start compare signal *c*, as shown by the dotted curve *r*, and in concurrence with a buffer loaded signal at curve *h* and a not print enable signal in curve *n* the carrier run flip-flop 48 will be turned on by an output from the AND 44 to restart the carrier 1 and in this case effect the printing of two characters.

In the instance under consideration it will be assumed that the position of the fourth character printed is too close to the position of the fifth character in the next array to permit immediately successive printing of the fifth character, so that the arithmetic logic 64 produces an output which is compared in compare 60 with the hammer recovery time from register 62, producing an output when there is not enough time for hammer recovery, to energize OR 56, which upon the occurrence of a stop compare signal from curve *e* resets the carrier run flip-flop 48 to stop the carrier motor 8. This sequence is shown by the dotted line *s*.

The carrier 1 is restarted, as shown by the dotted line *t* upon the occurrence of the next carrier start compare signal from the AND 42, which with the concurrence with a buffer loaded signal from latch 43 and a character present signal from the lookup table 31, produces an output from the AND 44 to turn on the carrier run flip-flop 48. As shown, three characters are printed and then the carrier 1 is stopped upon the termination of the print data ready signal represented by the curve *g* indicating the end of the data for printing. This is represented by the dotted line *u*, the inverter 59 producing an output when the buffer loaded signal drops. This output is applied to the OR 56, and through AND 54 upon the occurrence of a stop compare signal from AND 52, resets the carrier run flip-flop 48, thus stopping the carrier drive motor 8, through the carrier drive motor control 70.

From the above description and the accompanying drawing it will be apparent that the present invention provides a simple and effective printer control. By utilizing the arrangement shown increased throughput is possible. By utilizing a preferred arrangement of characters and having the print wheel traverse two or more print positions in one revolution in a normal uninterrupted sequence higher printing speeds are obtainable. By providing for carrier stop and restart whenever a character to be printed is not in the next array or whenever there is not enough time for hammer reset between characters, this arrangement is rendered most effective.

While the invention has been shown and described with respect to a print wheel, it will be understood by those skilled in the art that various changes in form and details such as number of type characters, type sets and arrangement may be made without departing from the scope of the invention and the invention may be practiced with other forms of print mechanisms such as drum printers or belt printers.

I claim:

1. In a printer, a carrier movable past a plurality of print positions along a print line of a document, a print element mounted on said carrier and having type bearing elements movable to print in different ones of said print positions on said document, said print element having two or more arrays of type characters, each array containing all of a group of commonly used characters and a different part of a group of less frequently used characters, said groups together comprising the entire set of printable characters to be used, means driving said print element, to present different ones of said type characters at said print position, driving means normally operable to drive said carrier at such a rate that only one of said arrays of characters is presented to a particular print position and other arrays are presented to successive adjacent print positions, a print hammer operable to effect impact of a selected type character with said document and having operating means for actuating said print hammer to impact selected ones of said type characters against said document to print thereon, and means including an emitter responsive to the positions of said type characters in said arrays on said print element and look ahead means operable to determine in advance the position in said arrays of a character which is to be printed in a particular print position operable to alter said normal operation and inhibit operation of said carrier driving means so as to stop said carrier when said character to be printed is not in the next array to be presented to said print position.

2. The invention as defined in claim 1 characterized by said inhibit means including, means for determining the position in said array of the next character-but-one to be printed, means providing a predetermined count representative of the recovery time of said print hammer, and means effective to inhibit the print hammer actuating and said carrier driving means if said preset hammer recovery count of said print hammer is greater than the difference between said next and said next-but-one character positions of said print wheel.

3. The invention as defined in claim 1 characterized by means including a lookup table containing the position in the next usable array of characters of the next character to print, and means for comparing the output of said lookup table with the output of a counter recording the position of the print element at the print position.

4. The invention as defined in claim 3 characterized by said means responsive to the positions of said type characters including an array counter connecting said emitter to said lookup table for determining whether the character for the next character position is in the next usable array of characters on said print wheel.

5. The invention as defined in claim 4 characterized by said lookup table means including data for determining whether the next-but-one character to be printed is in the next usable array of characters on said print wheel, and gate means responsive to the absence of said next-but-one character from said next usable array of characters to inhibit said carrier drive means.

6. The invention as defined in claim 5 characterized by said driving means being activated by bistable switch connected thereto and operable to one position in response to gate means controlled by an output from a type counter and a buffer loaded signal produced in response to the presence of a next character to be printed and an array end signal from said emitter, and operable to another position in response to an output from said lookup table indicating that the next-but-one character is not present in the next usable array.

7. The invention as defined in claim 6 characterized by logic means for determining the difference between the sum of the next-but-one character position and a preset array length register output, and the next character position, means providing a predetermined print hammer recovery time quantity, and means for resetting said carrier run bistable switch means if said difference is not greater than said hammer recovery time.

8. A serial printer apparatus comprising in combination a print mechanism operable for printing a line of characters or the like at plural uniformly-spaced print positions along a print line on a record medium, said print mechanism including a movable print element carrying a plurality of type characters in a predetermined fixed arrangement, said print mechanism having variable set-up times for presenting individual type characters on said print element depending on the relative location of said type characters on said print element during printing, means for effecting a relative motion of said print mechanism and said record medium whereby said print mechanism is positioned successively at each of said plural print positions along said print line, means for operating said print mechanism to effect recording of a succession of characters at said plural print positions during said relative motion, means operable for maintaining said relative motion at a constant first velocity when said set-up times for successive type characters to be printed at successive adjacent print positions occur within the traverse time of said print mechanism while moving at said first velocity across the space between adjacent print positions, traverse time determining means for determining when said set-up time for printing a character will exceed the traverse time between adjacent print positions at said first velocity, and velocity altering means responsive to said traverse time determining means for altering said relative motion between adjacent print positions to a second velocity including restoring said relative motion to said first velocity for printing at said adjacent print position.

9. A serial printer apparatus in accordance with claim 8 in which said velocity altering means includes means for stopping said relative motion during said traverse between adjacent print positions.

10. A serial printer apparatus in accordance with claim 9 in which said velocity altering means further includes means for accelerating said print mechanism to said first velocity after stopping before printing at the next adjacent print position.

11. A serial printer apparatus in accordance with claim 10 in which said print element is a type wheel.

12. A serial printer apparatus in accordance with claim 11 in which said type wheel is a constantly rotatable type wheel.

13. A serial printer apparatus in accordance with claim 12 in which said plurality of type characters carried by said type wheel comprises a complete set of characters or the like, and said print mechanism is moved plural print positions for each revolution of said type wheel during motion at said constant velocity.

14. A serial printer apparatus in accordance with claim 13 in which said plural type characters carried by said type wheel are arranged in two or more character arrays, said character arrays each having the same more commonly used characters and at least one other character not in the other arrays, said print mechanism is moved one print position of said print line for each array of charcters, said traverse time determining means includes character present means for determining the presence or absence of characters to be printed in said arrays, and means responsive to said character present means for altering said relative motion to said second velocity when a character to be printed is absent from a character array in position for printing.

15. A serial printer apparatus in accordance with claim 8 in which said transverse time determining means includes means for ascertaining during printing the relative positions on said type wheel of successive adjacent print positions, and means responsive to said ascertaining means for activating said moving means at said constant first velocity or said modified second velocity.

16. A serial printer apparatus in accordance with claim 8 in which said print mechanism includes an actuating means operable to cause said type element to contact said record medium at said positions, and means for determining the set-up times of said print mechanism at successive print positions of said print line, said means for determining said set-up times of said print mechanism including means for allowing for the recovery time of said actuating means.

17. The method of operating a printer, said printer having a print mechanism including a movable print element carrying a plurality of type characters or the like in a predetermined fixed arrangement, and drive means for effecting a relative movement of said print mechanism and a record medium for printing a line of characters at plural uniformly-spaced print positions along a print line on said record medium, said method comprising operating said drive means to effect relative motion of said print mechanism and said record medium at a constant first velocity when the set-up times for successive characters are no greater than the traverse time of said print mechanism across adjacent print positions and at a modified second velocity when the set-up times for said print mechanism exceed said traverse time, and restoring said relative motion during motion between adjacent print positions to said first velocity for printing during said relative motion at said first velocity.

18. In a printer, the method in accordance with claim 17 which further includes stopping said print mechanism between adjacent print positions, and accelerating said print mechanism to said first velocity after stopping before printing on-the-fly at the next adjacent print position.

* * * * *

UNITED STATES PATENT OFFICE
CERTIFICATE OF CORRECTION

PATENT NO. : 4,044,880

DATED : August 30, 1977

INVENTOR(S) : BLAIR R. MARTIN

It is certified that error appears in the above-identified patent and that said Letters Patent are hereby corrected as shown below:

Col. 1, line 10, "Inventiion" should read --Invention--
Col. 1, line 41, "Ser." should read --serial--
Col. 1, line 62, "positin" should read --position--
Col. 2, line 11, "hwheel" should read --wheel--
Col. 2, line 18, "pluraliity" should read --plurality--
Col. 2, line 24, "breifly" should read --briefly--
Col. 3, line 12, "on" should read --or--
Col. 3, lines 30 & 36, "FIg" should read --FIG--
Col. 3, line 54, "actuted" should read --actuated--
Col. 4, line 68, "next" should be underlined
Col. 6, line 4, "chracter" should read --character--

In the Claims:

Claim 15, Col. 10, line 15, after "successive" the phrase --characters to be printed at successive--was omitted.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*